US009410404B2

(12) United States Patent
Hammond Bravo

(10) Patent No.: US 9,410,404 B2
(45) Date of Patent: Aug. 9, 2016

(54) ARTIFICIAL SIMULTANEOUS PRODUCTION AND MAINTENANCE SYSTEM ASSISTED BY MECHANICAL PUMPING WITH FLEXIBLE TUBING FOR FLUID EXTRACTION

(75) Inventor: William Anthony Hammond Bravo, Mexico City, MN (US)

(73) Assignee: AVANTUB, S.A. de C.V., Reynosa (MX)

( * ) Notice: Subject to any disclaimer, the term of this patent is extended or adjusted under 35 U.S.C. 154(b) by 235 days.

(21) Appl. No.: 13/297,990

(22) Filed: Nov. 16, 2011

(65) Prior Publication Data

US 2012/0125599 A1 May 24, 2012

(30) Foreign Application Priority Data

Nov. 19, 2010 (MX) ..... MX/A/2010/012619

(51) Int. Cl.
*E21B 43/12* (2006.01)
*E21B 17/20* (2006.01)
*E21B 37/06* (2006.01)

(52) U.S. Cl.
CPC ..... *E21B 43/127* (2013.01); *E21B 17/20* (2013.01); *E21B 37/06* (2013.01); *E21B 43/126* (2013.01); *Y10T 29/49764* (2015.01)

(58) Field of Classification Search
CPC ..... E21B 43/126; E21B 43/127; E21B 37/06
USPC ..... 166/369, 68.5, 68, 312, 105, 377, 379, 166/380, 255.1, 371, 372, 311
See application file for complete search history.

(56) References Cited

U.S. PATENT DOCUMENTS

| | | | | |
|---|---|---|---|---|
| 3,939,910 | A * | 2/1976 | Bruce | E21B 33/06 166/84.2 |
| 4,418,609 | A * | 12/1983 | Wickline | F04B 47/02 74/110 |
| 5,095,976 | A | 3/1992 | Appleton | |
| 5,924,490 | A * | 7/1999 | Stone | 166/312 |
| 6,298,917 | B1 * | 10/2001 | Kobylinski et al. | 166/369 |
| 6,502,639 | B2 * | 1/2003 | Leniek, Sr. | 166/369 |
| 6,585,049 | B2 | 7/2003 | Leniek, Sr. | |
| 7,475,731 | B2 | 1/2009 | Victor | |
| 2008/0196902 | A1 * | 8/2008 | Head | 166/381 |

FOREIGN PATENT DOCUMENTS

EP 1852571 A1 11/2007

* cited by examiner

*Primary Examiner* — Jennifer H Gay
*Assistant Examiner* — George Gray
(74) *Attorney, Agent, or Firm* — David W. Carstens; Shaukat A. Karjeker; Carstens & Cahoon, LLP

(57) ABSTRACT

A pumping system for the simultaneous extraction of fluids and maintenance of a well. The pumping system includes a hollow production tubing secured at the surface and extending down into a well, and a flexible hollow tubing also secured to a surface structure and extending downward into the production tubing. A pump assembly connected to a lower end of the flexible tubing includes an upper section through which well maintenance fluids may be pumped, and a lower section that includes a mechanical pump. An impermeable barrier separates the upper and lower sections of the pump assembly. Holes formed on the upper and lower sections of the pumping assembly allow for the simultaneous maintenance of well and extraction of fluids.

3 Claims, 6 Drawing Sheets

ARTIFICIAL SIMULTANEOUS PRODUCTION AND MAINTENANCE SYSTEM ASSISTED BY MECHANICAL PUMPING WITH FLEXIBLE TUBING FOR FLUID EXTRACTION

FIELD OF THE INVENTION

The present invention is related to a system for fluid extraction from an oil well that lacks sufficient energy to lift the produced fluids to the surface. In particular, it is related to a simultaneous production and maintenance artificial system assisted by mechanical pumping with flexible tubing for fluid extraction, by pumping of chemicals into said oil well to modify the physical properties of the fluid to be extracted and to remove organic and inorganic matter deposited in the oil well.

BACKGROUND OF THE INVENTION

Oil is extracted by drilling a well on an oil field. A sufficient oil pressure will force the oil to flow out naturally for its subsequent processing and/or distillation. However, if there is not sufficient pressure for the oil to flow to the surface and to maintain the production, a sucker rod pump (also known as pump jack, beam pump, horsehead pump, etc.) system is used. This pump is the superficial part of a piston impellent pump.

The sucker rod pump systems are common in oilfield extraction and their size is determined by deepness, inner diameter of tubing inside the well and density or viscosity of the oil to be extracted, where a deeper extraction requires more energy to move greater lengths of fluid column. A rod-crank mechanism converts the engine's rotary movement into an alternate vertical movement that moves the rod of the pump producing a reiterative up-down movement.

Rod pumps are actuated by an engine. Said engine moves a pulley system which in turn is connected to a connecting rod to compensate the weight of the rod string reaching the bottom of the well. The connecting rod moves up and down a crank connected to a beam's end; the other end of the beam has a head. A steel cable connects the head with the polished rod that goes through a sealing box, permitting the movement inside and outside the tubing but not allowing the fluid to escape from the well (the tubing runs until the bottom of the well). On the bottom of the well there is a reciprocating pump, which has two valves: a static valve and a valve on the piston connected to the end of the rods with a superior-inferior path, known as the "traveling valve."

Once the sucker rod pump systems are installed, the production continues until problems appear, typically on the bottom of the well, with the deposit of substances like carbonates, paraffin, asphaltenes, sand, formation and corrosion residues, and the like.

Due to the deposit of the above-mentioned substances, the standing and traveling valve seats begin to wear out; as well as the spaces between the traveling container and the polished wall of exterior tubing of the reciprocating pump, causing lack of seal and failure to efficiently lift the oil to the surface; or even they get stuck preventing their proper operation. Likewise, the existing gas within the reservoir may lead to cavitations that hinder the pump, where due to the high gas compressibility, the build-up pressure is not sufficient to open the valves and little or nothing is pumped.

When this happens it is necessary to remove all the equipment from subsurface to the surface in order to repair or replace it. This operation is performed with rod equipment consisting of a rig with a winch with sufficient capacity to load all rods in the well. Extraction, substitution and introduction operation is performed in a 2 to 24 hour period, depending on the well's deepness. Then, it is convenient to clean the bottom of the well between each extraction-introduction in order to prevent any damage occur more frequently. Oil well cleaning needs from one to seven days according to the equipment used for cleaning (reparation equipment, line equipment or flexible tubing equipment); this implies costly operations and production loss for a long time.

Prior art typically discloses information about cleaning oil wells, as the U.S. Pat. No. 5,095,976, that brings protection to a cleaning equipment by means of an inner tubing and reciprocating elements.

Document U.S. Pat. No. 7,475,731 discloses an apparatus and method to clean an oil well by means of fluid injection and subsequent sediment suction.

The use of an apparatus to clean oil wells comprising a tubular conveyor extending from surface to the well portion to be cleaned by means of pumps on the bottom of the hole is known from document EP 1852571.

In addition to oil-well cleaning systems and/or methods included in prior art, there are documents protecting systems for a more efficient production of wells by sucker rod pumping, however those systems are susceptible to substance build-up causing lack of seal and consequently it is necessary to disassemble the entire equipment for replacement or maintenance.

A proper pumping system of dual displacement for fluid production of an oil well is described in document U.S. Pat. No. 6,585,049. This document discloses a pump and a dual displacement pumping system, wherein the system includes a subsurface pump, a production tubing column, a surface pumping unit connected to the subsurface pump by means transmitting reciprocating movements. Said document includes the presence of a production tubing column and has a production inside itself and in its annular portion, i.e. the intubation column. As in hydrocarbon extraction systems that include inner tubing in the intubation column, the system of U.S. Pat. No. '049 necessarily requires disassembling and separating the elements of surface and subsurface structure for preventive, predictive or corrective maintenance, that become into production losses.

The system described by U.S. Pat. No. 6,502,639 provides an improved pumping system including a subsurface pump, a tubing column and a surface pumping unit.

Subsurface pump is attached in the well and driven by the tube up and down repetitive movements. Subsurface pump pumps liquids to the surface through the intubation column. This patent describes a system using a tube to "move" a reciprocating pump; however, the system is exclusive for oil extraction and in case of failure or breakdown hindering functions, all the equipment must be disassembled, including that in the subsurface, to be repaired. In addition, the system extracts oil exclusively through concentric tubing leaving free the intubation column.

Thus, the state of the art does not mention a mechanical pumping system with flexible tubing for simultaneous extraction and cleaning of a well, making more efficient the productive process preventing expenses for repair or maintenance.

OBJECTS OF THE INVENTION

An object of the present invention is to provide an artificial simultaneous production and maintenance system assisted by mechanical pumping with flexible tubing for fluid extraction of a well, and simultaneous cleaning of said well.

Another object of the present invention is to provide an artificial simultaneous production and maintenance system assisted by mechanical pumping with flexible tubing for fluid extraction of a well where said well does not have the necessary reservoir power to lift the produced fluids to the surface.

A further object of the present invention is to provide an artificial simultaneous production and maintenance system assisted by mechanical pumping with flexible tubing for fluid extraction, wherein the internal tubing is flexible.

A further object of the present invention is to provide an artificial simultaneous production and maintenance system assisted by mechanical pumping with flexible tubing for fluid extraction, which makes maintenance and cleaning of the well without having to disassembling the extraction equipment and fixtures from subsurface or surface.

Another object of the present invention is to provide an artificial simultaneous production and maintenance system assisted by mechanical pumping with flexible tubing for fluid extraction, which reduces logistic and installation costs for being of easy maneuverability.

A further object of the present invention is to provide an artificial simultaneous production and maintenance system assisted by mechanical pumping with flexible tubing for fluid extraction that substitutes the steel bars or rods for flexible tubing that admits fluid circulation and allows coupling with a plunger pump.

Yet another object of the present invention is to provide an artificial simultaneous production and maintenance system assisted by mechanical pumping with flexible tubing for fluid extraction, wherein the flexible tubing admits injection of chemical fluids for cleaning, descaling the tubing, removing sand from the well and production system and reducing viscosity.

A further object of the present invention is to provide an artificial simultaneous production and maintenance system assisted by mechanical pumping with flexible tubing for fluid extraction, in which the production is obtained through production tubing in its annular space with the flexible tubing.

Yet another object of the present invention is to provide an artificial simultaneous production and maintenance system assisted by mechanical pumping with flexible tubing for fluid extraction, wherein the flexible tubing admits injection of chemical fluids to clean the wellbore.

A further object of the present invention is to provide an artificial simultaneous production and maintenance system assisted by mechanical pumping with flexible tubing for fluid extraction, which allows pumping fluids from the surface inside or through the flexible tubing to make efficient cleaning and external displacement, outside the flexible tubing, to reach an optimum speed in annular area for cleaning and production of hydrocarbons.

BRIEF DESCRIPTION OF THE DRAWINGS

The invention will be described in more detail according to the appended figures, wherein.

Figure 1:
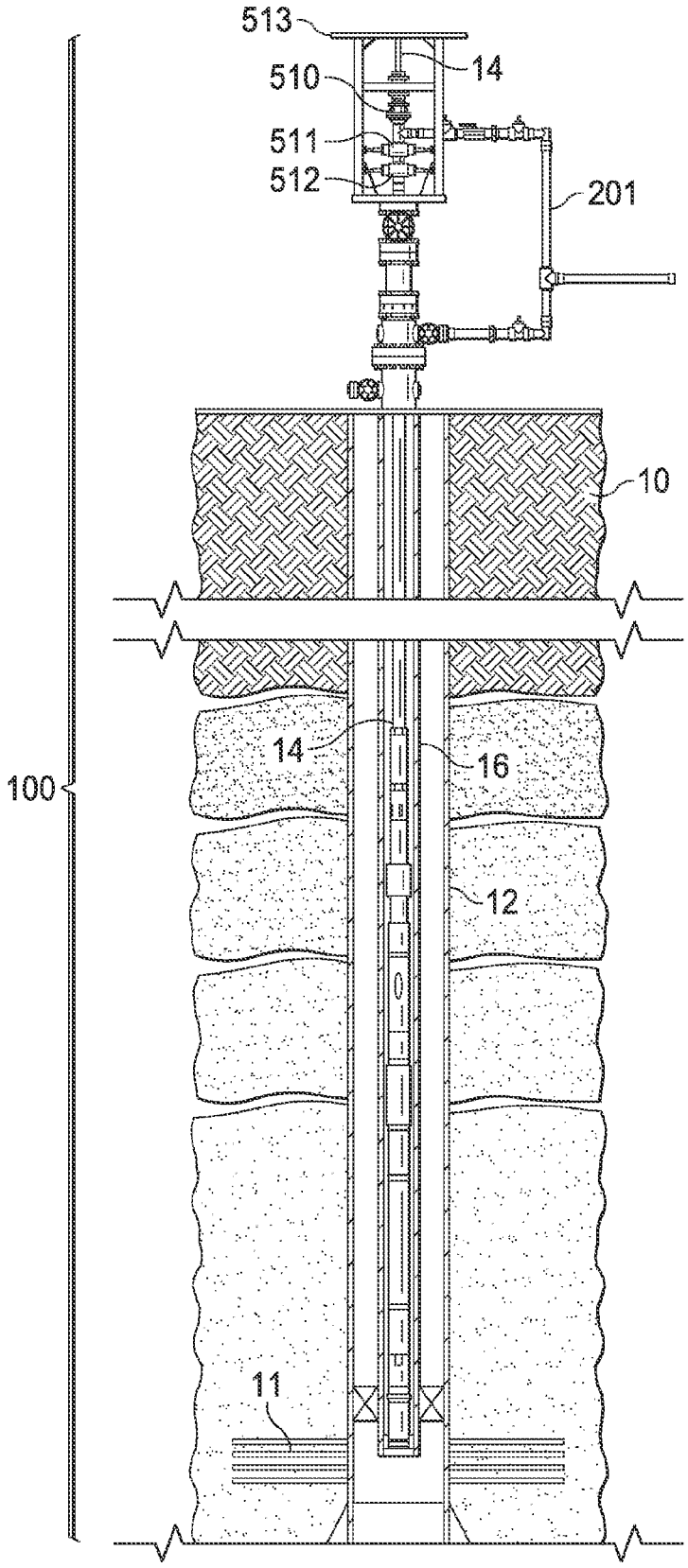
FIG. 1 shows a front view of an artificial simultaneous production and maintenance system assisted by mechanical pumping with flexible tubing for fluid extraction.

Next a list of technical elements of the invention is shown:

LIST OF TECHNICAL ELEMENTS OF THE INVENTION artificial simultaneous production and maintenance system assisted by mechanical pumping with flexible tubing for fluid extraction (100)
reservoir (11)
well (10)
well casing (12)
surface assembly (30)
connection and splicing means (15)
production tubing (16)
flexible tubing (14)
connector (17)
pump assembly (19)
anchoring shoe (197)
check valve (192)
cleaning tool (194)
flow ports (1941)
blind plug (195)
production holes (200)
annular space (20)
stationary pump (21)
discharge pipe (201)
hydraulic drive head system (50)
hydraulic connection (501)
hydraulic pistons (502)
pulleys (503)
pump connection type 1502 (504)
guide car (505)
clamp (506)
high pressure connector (507)
swivel connection (508)
pumping hose (509)
stuffing box system (510)
Preventer with O-ring seals (511)
wedge preventer (512)
sub-base (513)
steel cable (514)
metal structure (515)
stroke sensor (516)
swivel connection (517)
fixed metal pipe (518)

DETAILED DESCRIPTION OF THE INVENTION

With reference to the appended drawings, particularly FIG. 1 illustrates an artificial simultaneous production and maintenance system assisted by mechanical pumping with flexible tubing for fluid extraction (100). FIG. 1 shows a well (10) extending from the soil surface through the ground to connect with the reservoir (11).

Oil or hydrocarbon of the reservoir (11) is extracted through the well (10). The artificial simultaneous production and maintenance system assisted by mechanical pumping with flexible tubing for fluid extraction (100) of the present invention is installed inside the well (10). This system includes a casing (12) extending across the well (10) from the surface until the reservoir (11).

The artificial simultaneous production and maintenance system 100 of the present invention works along with equipment mounted on the well surface by means of an assembly 30 which for that purpose includes a sub-base 513 and a hydraulic head 50. The equipment that forms part of the state of the art is responsible for supporting the weight of the tubing for fluid circulation to the surface and downhole.

The surface assembly (30) that forms part of the artificial simultaneous production and maintenance system assisted by mechanical pumping with flexible tubing for fluid extraction (100) includes: a stuffing box system (510) to control production fluids outside, as well as a preventer (511) with O-ring seals, and a wedge preventer (512) to hold flexible tubing. At the wellhead (10), as part of the surface assembly (30), a connection and splicing means (15) is found; it consists of a flange (bridle) joining the surface assembly (30) with a production tubing (16). The connection and spicing means (15) allows holding and locking the production tubing (16). The production tubing (16) extends vertically downwards inside the casing (12), being production tubing (16) inside the casing (12) concentrically one to each other. Likewise, from surface equipment a flexible tubing (14) extends vertically downwards, from there it is projected again to continue its original direction downwards inside the well bore (10).

Flexible tubing (14) is located directly inside the production tubing (16), all along its length, being then the casing (12), production tubing (16) and flexible tubing concentric (14) to each other.

FIG. (2) shows a pump assembly (19) according to the present invention. The pump assembly (19) is fastened to the lower end of the flexible tubing (14), seated and anchored through a anchoring shoe (197) of the production tubing (16). Fastening between the pump assembly (19) and flexible tubing (14) is performed by a connector (17), link element located on the upper part of the pump assembly (19).

Likewise, another element included in the pump assembly (19) is the check valve (192) that prevents the fluids and chemicals to flow back within the flexible tubing (14). In the pump assembly (19), the check valve (192) in turn is connected to a cleaning tool (194). The cleaning tool (194) includes on its surface a plurality of flow ports (1941). These flow ports (1941) consist of outlet holes for fluid and chemicals that will be pumped from the surface within the flexible tubing (14).

The cleaning tool (194) is the element from the pump assembly (19) where the pumped liquids flow from the surface. This cleaning tool (194) is coupled by a blind plug (195) directly to the standing pump (21) of the pump assembly (19). The blind plug (195) is the only element of the pump assembly (19) where no fluid flows, whether from surface or directly extracted from the reservoir (11).

Blind plug (195) is thread connected to the stationary pump (21) that allows, through the production holes (200), the exit of production fluid from the reservoir (11), to be pumped through the annular space (20) to the surface.

Such as mentioned in the background chapter herein, one of the most frequent problems in the mechanical pumping system is sand drag from the reservoir (11) to the production tubing, directly affecting the pumping and transport system of crude oil or any hydrocarbon to the surface. Sand buildups in pumps or any element of the extraction system by mechanical pumping creates reduced efficiency and component wear, surpassing tolerances, therefore the well stops production.

Subsequently, the well extraction system is programmed for preventive and corrective maintenance, requiring disassembling the entire system for cleaning, changing pump, pipes, couples or other fixtures, which implies losses for stopping productive process and production times.

Figure 4:
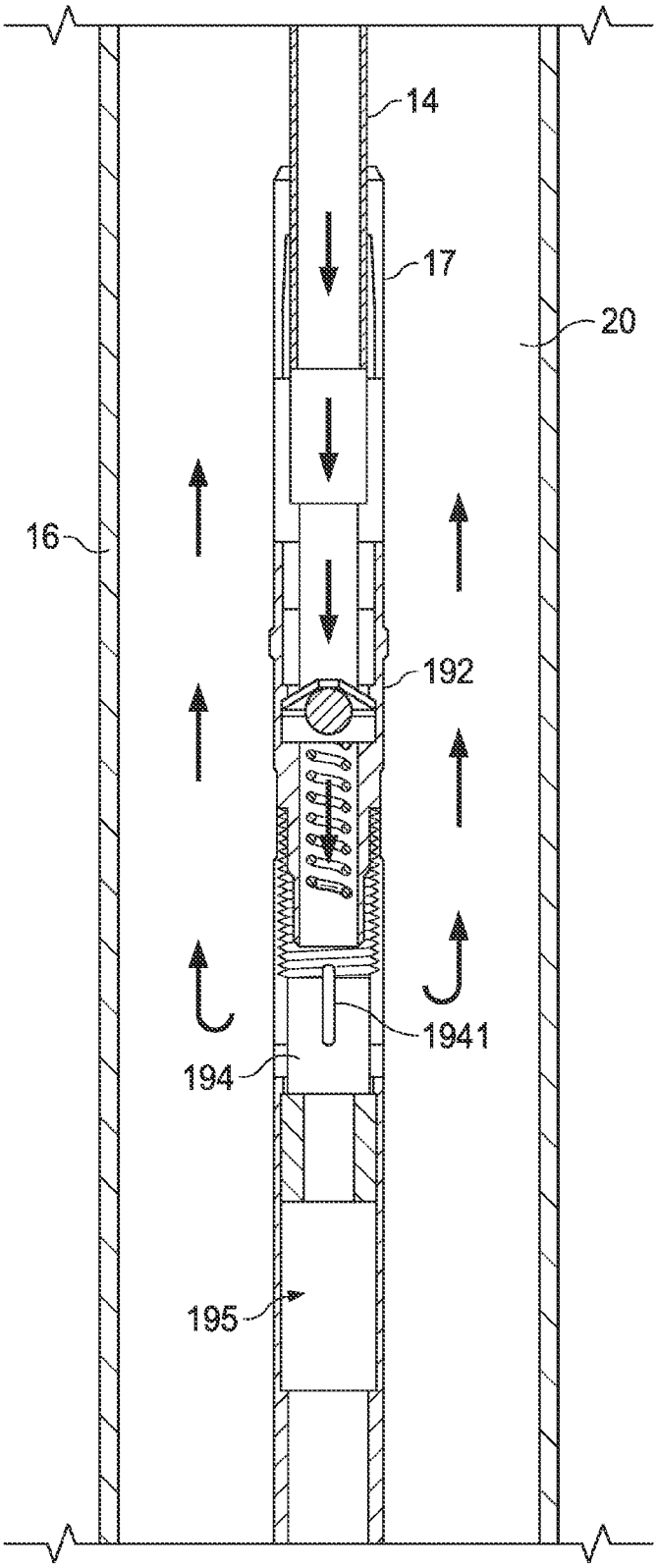
FIG. 4 shows a schematic view of the flow of the chemical or chemical fluid of the artificial simultaneous production and maintenance system assisted by mechanical pumping with flexible tubing for simultaneous fluid extraction and cleaning of a well.
Figure 5:
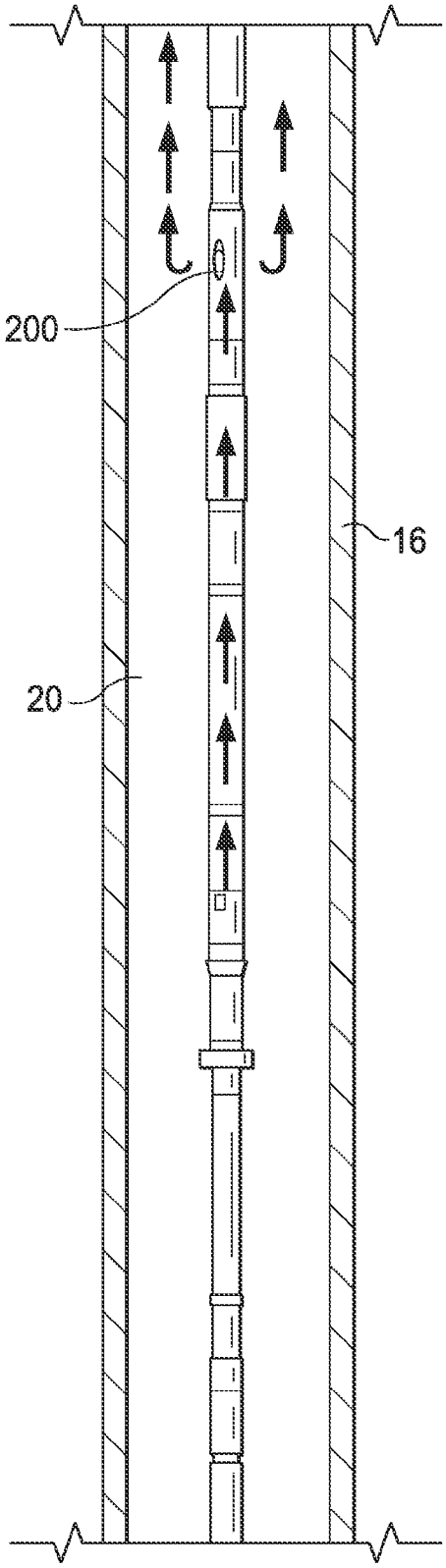
FIG. 5 shows a schematic view of the flow of the production fluid of the artificial simultaneous production and maintenance system assisted by mechanical pumping with flexible tubing for fluid extraction.

In contrast to all the above, with reference to FIG. 4, it shows circulation pattern of chemicals and fluids inside the artificial simultaneous production and maintenance system (100) assisted by mechanical pumping with flexible tubing for fluid extraction. Fluids are pumped from the well surface by the surface equipment through the flexible tubing (14) until the cleaning tool (194), where the pumped fluid will exit through the flow ports (1941). Such as we can observe from arrows representing fluid circulation in FIG. 4, the flow pumped inside the flexible tubing (14) returns again to the surface by flowing through the annular area (20) formed by both the flexible tubing (14) and production tubing (16). Variety of fluids to be pumped for well maintenance may be among others: necessary fluids for cleaning and desanding the well, chemicals to dissolve paraffin deposits, asphalts and scaling caused by carbonates, chemical fluids to modify several parameters of fluids coming from the reservoir as viscosity, density, etc.

Related to the above, the artificial simultaneous production and maintenance system assisted by mechanical pumping with flexible tubing for fluid extraction (100) allows continuous injection of viscosity reducer agents to improve production during operation of stationary pump (21). It is important to mention that pumping any of the above chemicals can be made during oil or hydrocarbon extraction from reservoir (11). In this way maintenance to the artificial simultaneous production and maintenance system assisted by mechanical pumping with flexible tubing for fluid extraction (100) can be applied in well (10), by pumping chemicals from the surface equipment to clean, dissolve paraffin, asphalt deposits, descaling mineral salts and reduce viscosity. Chemicals flow inside the flexible tubing (14) no needing to extract the mechanical pumping apparel, including the pump, which implies important savings in dead time of equipment of well (10). Likewise it is possible an efficient sand and solid dragging to the surface making them to flow by annular area (20) of the artificial simultaneous production and maintenance system assisted by mechanical pumping with flexible tubing for fluid extraction (100) of the present invention. All the above helps preventing failures in pumps in the artificial simultaneous production and maintenance system assisted by mechanical pumping with flexible tubing for fluid extraction (100) substantially increasing production time of well (10) before a major repair or maintenance.

It is important to point out that the artificial simultaneous production and maintenance system assisted by mechanical pumping with flexible tubing for fluid extraction (100) is a novel system requiring less installation and extraction time than any other conventional mechanical pumping system. For example, the flexible tubing string (14) can be designed according to deepness, pressure and expected loads during operation, varying diameter, wall thickness and stiffness of the material. Thus, we can preview the inner displacement in flexible tubing (14) for efficient cleaning and/or maintenance, and external displacement in flexible tubing (14) jointly with inner displacement of production tubing (16) to have annular area (20) for the optimum hydrocarbon production.

On the other hand, and in virtue that flexible tubing (14) bends or plies easily and is continuous, without connections or links, its installation and/or extraction is notably faster than a rod or coupling piping system.

Features of the flexible tubing (14) and equipment in general of the artificial simultaneous production and maintenance system assisted by mechanical pumping with flexible tubing for fluid extraction (100) make possible to maintain pressure control, permitting maneuvers during production in the well (10), no need fluids to control the pressure.

Related to production in well (10), reference is made to FIG. (5), which illustrates fluid circulation from reservoir (11) inside the artificial simultaneous production and maintenance system assisted by mechanical pumping with flexible tubing for fluid extraction. The fluid is pumped from the reservoir (11) to the oilwell surface through the pump assembly (19). Fluid production from reservoir (11) enters through the stationary pump (21), located on the lower portion of the pump assembly (19), and exits trough production holes (200) towards the annular space (20) for subsequent flow to the surface through the annular space (20) formed between the interior of production tubing (16) and flexible tubing (14). Thus, there is a displacement of internal fluid through flexible tubing (14) inwards the well to make efficient cleaning and maintenance out from the flexible tubing, to maintain an optimum annular space for hydrocarbon production.

The artificial simultaneous production and maintenance system assisted by mechanical pumping with flexible tubing for fluid extraction (100) including a flexible tubing (14) substantially reduces maintenance costs in the well (10), due to easiness to pump chemicals and reduce frequency of interventions to repair the well. With the artificial simultaneous production and maintenance system assisted by mechanical pumping with flexible tubing for fluid extraction (100), suspension of operation times of the well for cleaning and desanding are very reduced, because it is possible to add chemicals, like any of those herein mentioned above, during functioning of mechanical pumping; allowing thus optimization of production of well (10), and consequently saving costs when operating the well.

Likewise evidently depending on the deepness or characteristics of the well (10), the reservoir capacity, type of hydrocarbon extracted and/or type of oil field where the well (10) is located, the artificial simultaneous production and maintenance system assisted by mechanical pumping with flexible tubing for fluid extraction (100) of the present invention could vary in length, thickness and/or capacity of each element conforming the artificial simultaneous production and maintenance system assisted by mechanical pumping with flexible tubing for fluid extraction (100).

Figure 2:
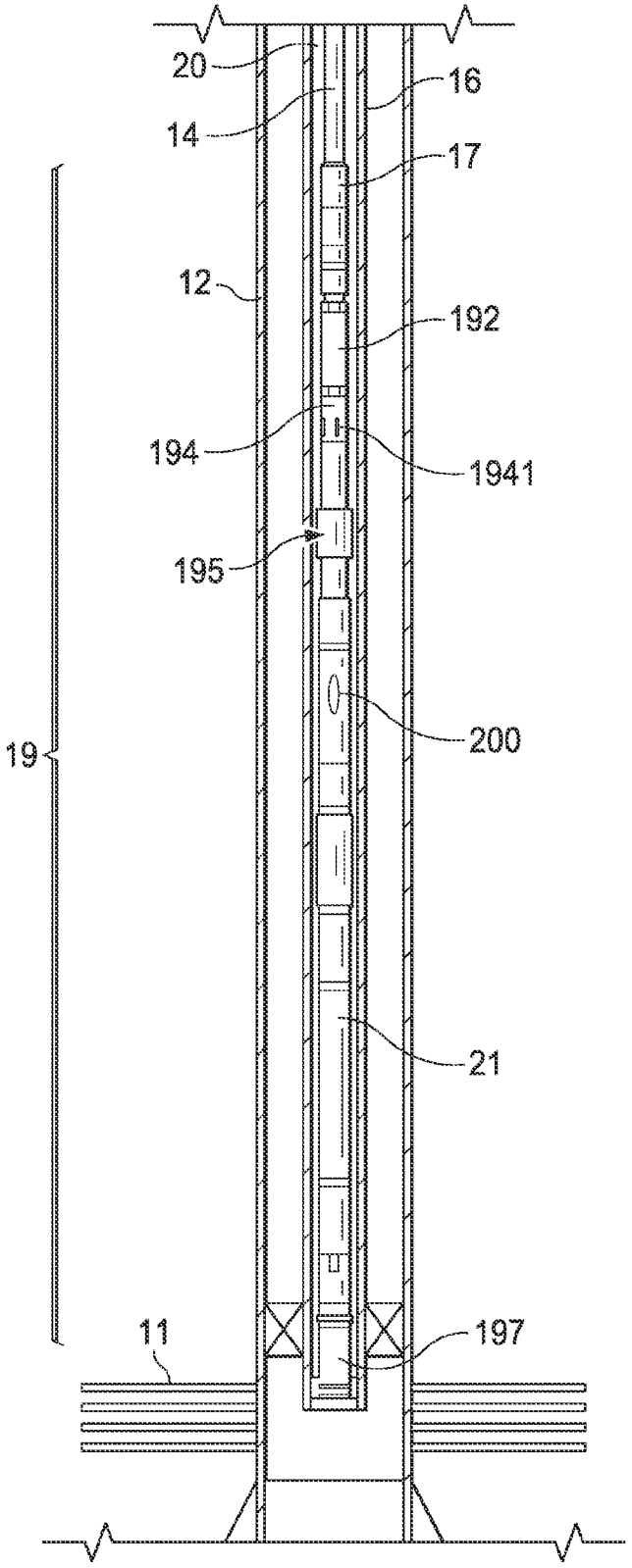
FIG. 2 shows a front view of a bottom assembly forming part of the artificial simultaneous production and maintenance system assisted by mechanical pumping with flexible tubing for fluid extraction.
Figure 3:
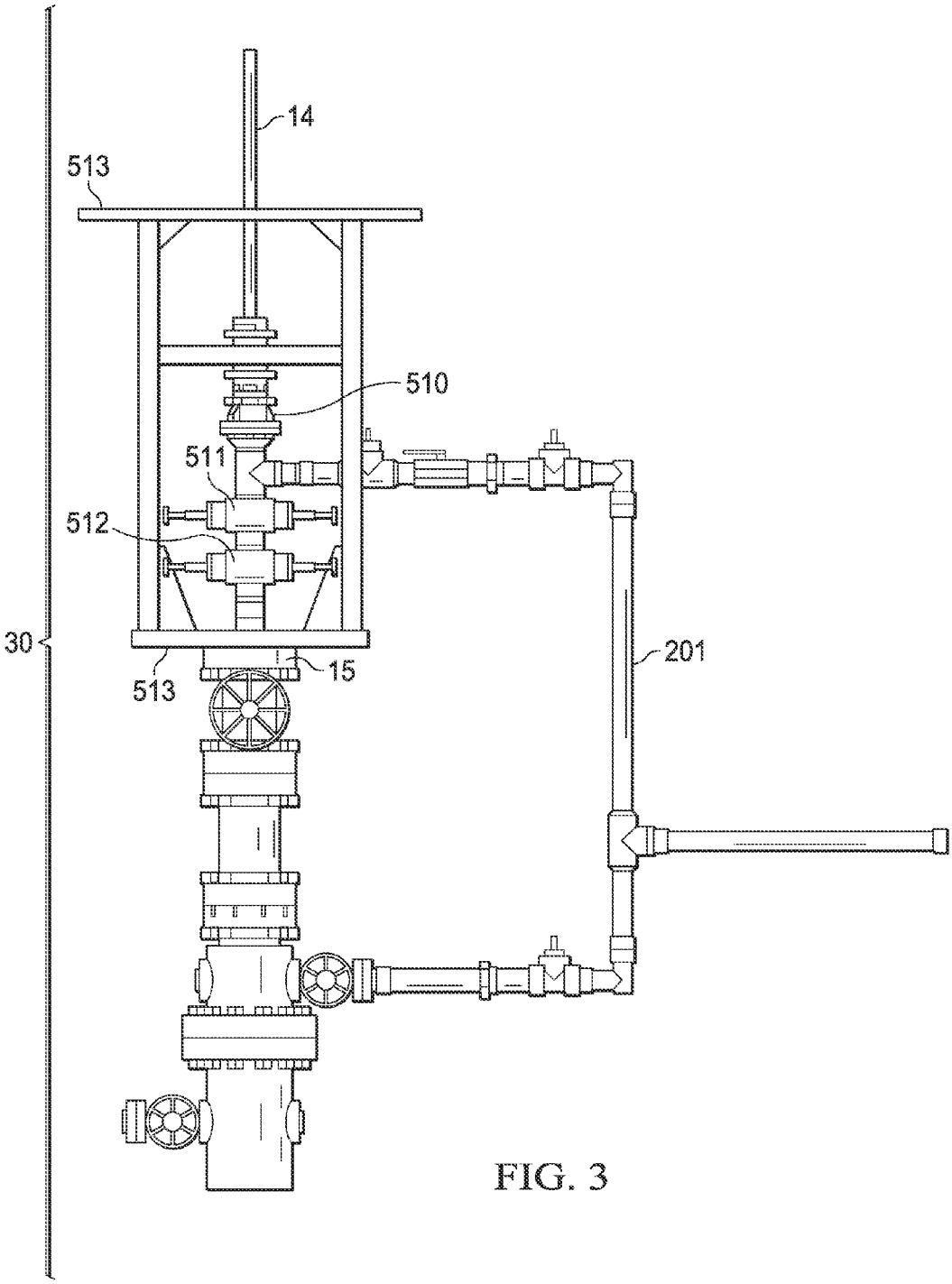
FIG. 3 shows a front view of a surface assembly forming part of the artificial simultaneous production and maintenance system assisted by mechanical pumping with flexible tubing for fluid extraction.
Figure 6:
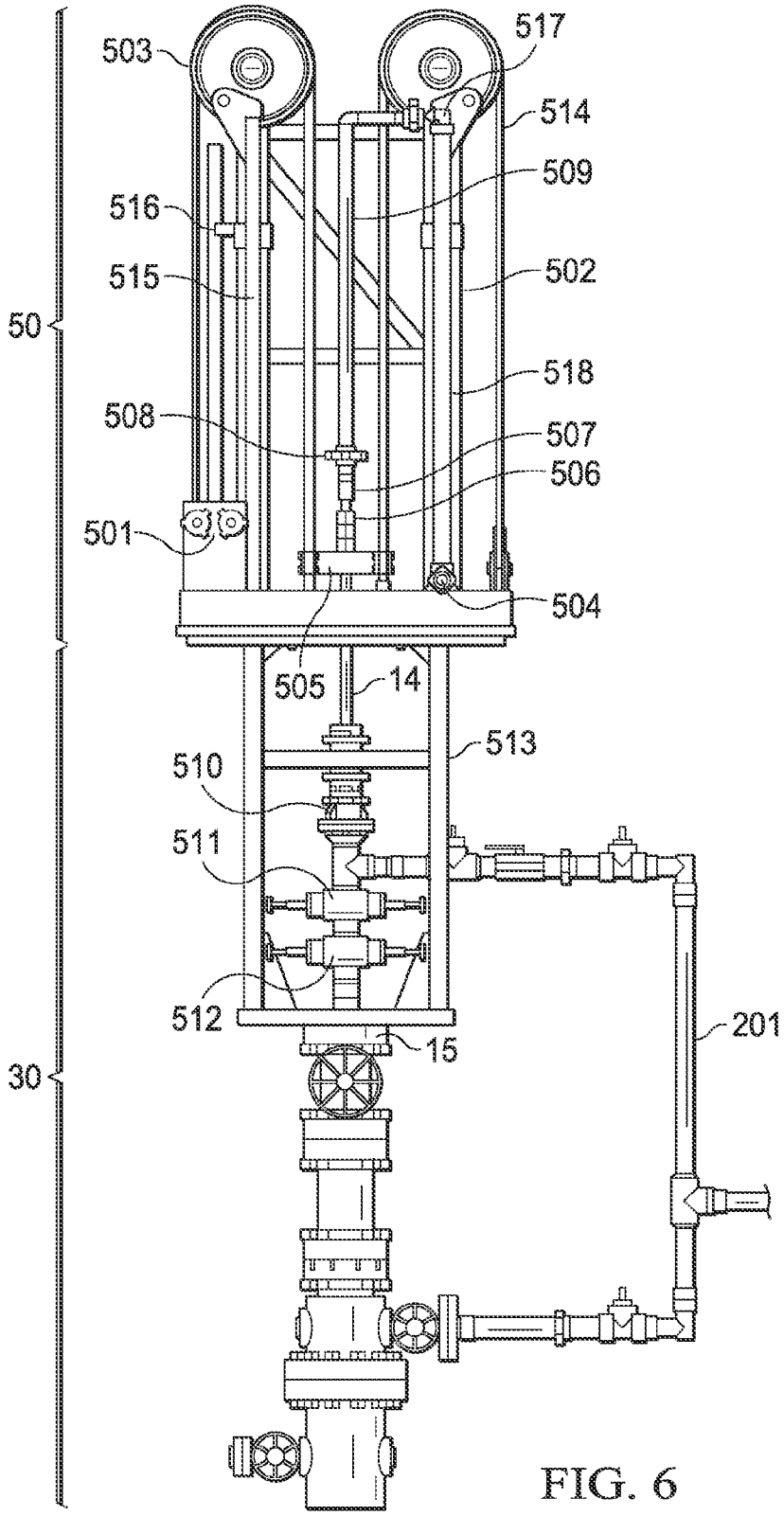
FIG. 6 shows a front view of the hydraulic drive head assembly forming part of the artificial simultaneous production and maintenance system assisted by mechanical pumping with flexible tubing for fluid extraction.

Finally, related to functioning of the hydraulic drive head, FIG. 6 shows the purpose for this head, which is to transfer the mechanical movement produced by an hydraulic power unit to the flexible tubing (14) to have an ascending and descending movement while the production tubing remains static inside the well. At the same time it is used to support all the weight of the flexible tubing (14) and the bottom assembly (19) shown in FIG. 2.

Ascending movement produced by the hydraulic drive head (50) is originated by hydraulic flow received from a power unit not shown in the figures. Hydraulic flow is received through hydraulic connections (501); said hydraulic flow extends the hydraulic pistons (502) lengthwise making the steel cables (514) to go through a pulley set (503) and lift a guide car (505), which in turn lifts the flexible tubing (14); this later is fastened to the guide car by a clamp set (506).

Descending movement produced by the hydraulic drive head (50) is originated by emptying the hydraulic fluid of hydraulic pistons (502) in a controlled way by the same hydraulic power unit. This movement is performed in reverse to the ascending movement previously described.

Another function of the hydraulic head (50) is to permit introduction of fluid or chemical to the well by the flexible tubing (14). This happens by pumping the fluids or chemicals through a pumping connection (504) known as type (1502), the fluid is transferred to a fixed metal pipe (518) fastened to the metallic structure (515). This pipe is connected to a flexible hose by a swivel connection (517) and the other end of the hose (509) is connected to the flexible tubing (14) by another swivel connection (508) and a high pressure connector (507), and signaling as a basic element the discharge tubing (201), where the final product circulates (derived from the flow obtained in the well).

From the above it is appreciated that, even though specific embodiments of the invention have been described herein for illustration purposes only, several modifications can be made without affecting the scope of the invention. Therefore, the invention is not limited except by the appended claims.

The invention claimed is:

1. A simultaneous production and maintenance system for a pumped production well at a reservoir, the system comprising:

a) a hydraulic drive head producing and transmitting vertical reciprocal motion, the hydraulic drive head comprising:
   (i) a hydraulic connection receiving hydraulic fluid,
   (ii) hydraulic pistons driven by the hydraulic fluid,
   (iii) a set of pulleys including upper and lower pulleys, the upper pulleys each coupled to and rotated by one of the hydraulic pistons, the set of pulleys coupled to a guide car, the upper pulleys having parallel axes of rotation, and the lower pulleys having axes of rotation at right angles to the upper pulleys,
   (iv) steel cables passing over each of the pulleys of the set of pulleys, such that reciprocation of the hydraulic pistons drives the set of pulleys causing vertical reciprocal motion of the hydraulic drive head, and
   (v) a pump connection;

b) a surface assembly, mechanically coupled to the hydraulic drive head, the surface assembly holding and securing a first flexible tubing for circulation of fluids in the well, the surface assembly comprising a sub-base comprising a stuffing box system for controlling an output of production fluids out of the well, a preventer with O-ring seals, and a wedge-preventer, a discharge pipe, and a connection and splicing mean having a flange joining the surface assembly with production tubing;

c) the first flexible tubing secured by the wedge preventer and extending from above the well to within the well, the first flexible tubing coupled to the hydraulic drive head and subject to the reciprocal motion transmitted from the hydraulic drive head, the first flexible tubing coupled to an end of a pumping second flexible tubing by a swivel connection, the other end of the second flexible tubing end is coupled to a fixed metal tube by means of a second swivel connection coupled to a pump connection of the hydraulic drive head such that during operation, cleaning chemical fluid is pumped into the well via the pump connection and through the second flexible tubing and then through to the first flexible tubing;

d) a production tubing concentric with and outside the first flexible tubing thereby forming an annular space therebetween; and e) a pump assembly coupled to the first flexible tubing, the pump assembly comprising, sequentially from the bottom up, a stationary subsurface pump, a flow conduit having production holes, a blind plug, a cleaning tool having a plurality of flow ports, and a check valve, the cleaning tool coupled to the stationary subsurface pump by the blind plug, whereby during use in maintenance, the blind plug blocks flow of produced fluids from travelling up the cleaning tool and diverts the produced fluids through the production holes of the flow conduit into the annular space, and the cleaning chemicals fluid travelling down inside the first flexible tubing are blocked by the check valve, and thereby flow out of the plurality of flow ports into the annular space to commingle in the annular space with the produced fluids;

wherein, as assembled, the hydraulic drive head, and the surface assembly are in vertical line with the first flexible tubing, the production tubing, and the pump assembly;

wherein, during operation, when a hydraulic fluid is charged through the hydraulic connection to the hydraulic drive head, the hydraulic fluid passes to the hydraulic pistons causing the hydraulic pistons to extend longitudinally upwards to lift the guide car, and when the hydraulic fluid is drained, the hydraulic pistons extend longitudinally downward in the hydraulic drive head to lower the guide car; the motion of the guide car thereby causing an ascending and descending reciprocal motion of the first flexible tubing actuating the stationary subsurface pump.

2. The system of claim 1, wherein a connector secures the pump assembly to the flexible tubing.

3. The system of claim 1, wherein an anchoring shoe secures the pump assembly to the production tubing.

* * * * *